US009890668B2

(12) United States Patent
Kim

(10) Patent No.: US 9,890,668 B2
(45) Date of Patent: Feb. 13, 2018

(54) METHOD AND SYSTEM FOR DETECTING MALFUNCTION OF FASTENING BOLT IN CVVT

(71) Applicants: HYUNDAI MOTOR COMPANY, Seoul (KR); KIA MOTORS CORPORATION, Seoul (KR)

(72) Inventor: Seung Bum Kim, Seongnam-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 329 days.

(21) Appl. No.: 14/720,689

(22) Filed: May 22, 2015

(65) Prior Publication Data

US 2016/0146071 A1 May 26, 2016

(30) Foreign Application Priority Data

Nov. 25, 2014 (KR) ..... 10-2014-0164881

(51) Int. Cl.
*F01L 3/24* (2006.01)
*F01L 13/00* (2006.01)

(52) U.S. Cl.
CPC ..... *F01L 3/24* (2013.01); *F01L 13/00* (2013.01); *F01L 2013/111* (2013.01)

(58) Field of Classification Search
CPC ..... F01L 3/24; F01L 13/00; F01L 2013/111
See application file for complete search history.

(56) References Cited

U.S. PATENT DOCUMENTS

2008/0066700 A1* 3/2008 Mashiki ..... F01L 1/022 123/90.11
2011/0146602 A1* 6/2011 Kato ..... F01L 1/3442 123/90.12

FOREIGN PATENT DOCUMENTS

| | | | |
|---|---|---|---|
| JP | 2003-314228 | A | 11/2003 |
| JP | 2007315379 | A | 12/2007 |
| JP | 2008-069719 | A | 3/2008 |
| JP | 4947499 | B2 | 6/2012 |
| KR | 10-2004-0002578 | A | 1/2004 |
| KR | 20090118734 | A | 11/2009 |

OTHER PUBLICATIONS

Korean Office Action issued in Korean Patent Application No. 10-2014-0164881, dated Jan. 15, 2016.

* cited by examiner

*Primary Examiner* — Paul West
*Assistant Examiner* — Xin Zhong
(74) *Attorney, Agent, or Firm* — McDermott Will & Emery LLP

(57) ABSTRACT

A method for detecting malfunction of a fastening bolt in a continuous variable valve timing (CVVT) includes: deciding whether a camshaft position sensor is operating normally; learning the most retarded angle position of the camshaft using the camshaft position sensor; deciding whether the learning of the most retarded angle position of the camshaft is normal; and comparing a PWM duty value used in the learning with a set first reference value when the learning of the most retarded angle position of the camshaft is normal.

2 Claims, 3 Drawing Sheets

METHOD AND SYSTEM FOR DETECTING MALFUNCTION OF FASTENING BOLT IN CVVT

CROSS REFERENCE TO RELATED APPLICATION

The present application claims priority of Korean Patent Application Number 10-2014-0164881, filed on Nov. 25, 2014 with the Korean Intellectual Property Office, the entire contents of which application are incorporated herein for all purposes by this reference.

BACKGROUND OF THE INVENTION

1. Field of the Invention

The present invention relates, in general, to a method and system for detecting malfunction of a fastening bolt in a continuous variable valve timing (CVVT). More particularly, the present invention relates to a technique that can detect malfunction such as release of a bolt used in a CVVT by respectively comparing a PWM duty value used in learning of the most retarded angle position of a camshaft and a PWM duty value used in learning of the response speed of a CVVT actuator with set reference values.

2. Description of the Related Art

In general, a continuous variable valve timing (CVVT) is a device for controlling the valve opening/closing time of an engine. Particularly, the CVVT controls an intake valve according to driving conditions, so that it is possible to improve the output and fuel efficiency of the engine and to reduce the amount of exhaust gas.

The CVVT drives a camshaft with a DC motor. The camshaft is rotated using a PWM duty value in an engine control unit (ECU), and valve timing is changed by the rotation of the camshaft.

Meanwhile, a phenomenon that a fastening bolt in the CVVT is released during driving of a vehicle due to tolerance in assembling of the CVVT occurs as a problem that occurs in the vehicle provided with the CVVT. Although the DC motor is controlled through the PWM duty value in the ECU, the camshaft does not rotate due to the release of the fastening bolt. As a result, the starting of the vehicle is terminated due to RPM drop, and the durability of the DC motor is problematic due to erroneous learning of the position of the camshaft.

Accordingly, the present invention has an object to provide a method and system for detecting malfunction of a fastening bolt in a CVVT, which can provide analysis of the cause in which the starting of a vehicle is terminated by deciding, in an ECU, a release phenomenon of the fastening bolt in the CVVT, and solve a problem through simple tightening of the bolt based on the analysis of the cause.

The items described as the background art are provided just to help understanding of the background of the present invention, and shall not be construed to admit that they correspond to the technologies already known to those skilled in the art to which the present invention pertains.

SUMMARY OF THE INVENTION

Accordingly, the present invention has been made keeping in mind the above problems occurring in the prior art, and an object of the present invention is to provide a method and system for detecting malfunction of a fastening bolt in a continuous variable valve timing (CVVT), in which a release phenomenon of the fastening bolt in the CVVT is detected in an engine control unit (ECU), so that it is possible to more accurately and quickly notify a driver of the detected phenomenon and to solve the release phenomenon of the fastening bolt.

In accordance with an aspect of the present invention, there is provided a method for detecting malfunction of a fastening bolt in a CVVT, the method including: deciding whether a camshaft position sensor is operating normally; learning the most retarded angle position of a camshaft using the camshaft position sensor; deciding whether the learning of the most retarded angle position of the camshaft is normal; and comparing a PWM duty value used in the learning with a set first reference value when the learning of the most retarded angle position of the camshaft is normal.

The method may further include: after the comparing of the PWM duty value used in the learning with the set first reference value when the learning of the most retarded angle position of the camshaft is normal, learning the response speed of a CVVT actuator; deciding whether the learning of the response speed is normal as the learned response speed is within a set range; and comparing a PWM duty value used in the learning with a set second reference value when the learning of the response speed is normal.

The first reference value may be greater than the second reference value. When the PWM duty value used in the learning is smaller than the first reference value when the learning of the most retarded angle position of the camshaft is normal, and the PWM duty value used in the learning is greater than the second reference value when the learning of the response speed is normal, it may be decided that malfunction has occurred in the fastening bolt in the CVVT.

The first reference value may be 45% and the second reference value may be 38%.

In accordance with another aspect of the present invention, there is provided a system for detecting malfunction of a fastening bolt in a CVVT, the system including: a CVVT actuator configured to include a housing and a rotor mounted in the housing; a camshaft position sensor learning the most retarded angle position of a camshaft; and a controller configured to transmit a PWM duty value for rotation of a camshaft and a PWM duty value for operation of the CVVT actuator and store the transmitted PWM duty values, wherein, when it is decided that the learning of the most retarded angle position of the camshaft is normal, and a PWM duty value used in the learning is smaller than a set first reference value, the controller decides that malfunction has occurred in the fastening bolt in the CVVT.

When the learning of the response speed of the CVVT actuator is normal, and a PWM duty value used in the learning is greater than a set second reference value, the controller may decide that malfunction has occurred in the fastening bolt in the CVVT.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
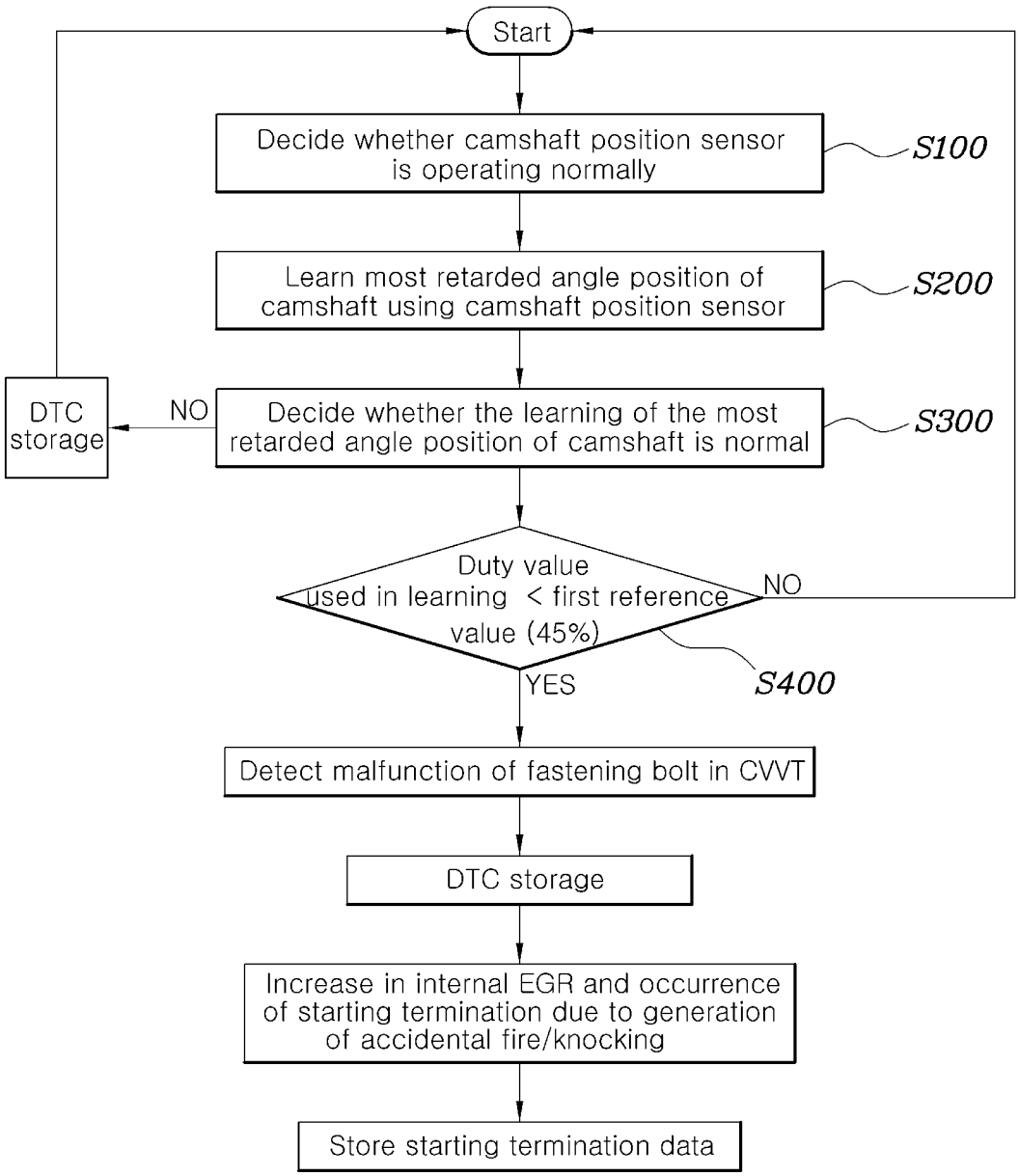
FIGS. 1 and 2 are flowcharts illustrating a continuous variable valve timing (CVVT) bolt release detection logic in accordance with an embodiment of the present invention.

Hereinafter, embodiments of the present invention will be described in detail with reference to the accompanying drawings. Reference now should be made to the elements of drawings, in which the same reference numerals are used throughout the different drawings to designate the same elements. In the following description, detailed descriptions of known elements or functions that may unnecessarily make the gist of the present invention obscure will be omitted.

Hereinafter, exemplary embodiments of a system and method for detecting malfunction of a fastening bolt in a continuous variable valve timing (CVVT) in accordance with the present invention will be described with reference to the accompanying drawings.

In the present invention, the malfunction of the fastening bolt in the CVVT is detected through a CVVT bolt release detection logic for respectively comparing a PWM duty value used in learning of the most retarded angle position of a camshaft and a PWM duty value used in learning of the response speed of a CVVT actuator with set duty values.

That is, in the present invention, an engine control unit (ECU) detects a release phenomenon of the fastening bolt in the CVVT using the PWM duty values used in the learning of the most retarded angle position of the camshaft and the learning of the response speed of the CVVT actuator.

Meanwhile, if changes in PWM duty value are observed based on various samples at the maximum operating position of the camshaft, a PWM duty value not more than 45% of the PWM duty value learned at the maximum operating position of the camshaft cannot be detected, and simultaneously, a PWM duty value not less than 38% of the PWM duty value cannot be detected based on the maximum operating speed of the CVVT.

That is, when a problem caused by bolt release occurs in a vehicle having the CVVT mounted therein, the ECU can detect that there has occurred a release phenomenon of the fastening bolt when a PWM duty value out of the range of the limit value described above is transmitted, in order to set the position of the camshaft to a target value.

Accordingly, if the ECU detects a PWM duty value out of the limit value of the PWM duty value as described above, the ECU decides that the fastening bolt has been released.

Flowcharts of the CVVT bolt release detection logic that is the present invention in which a control logic is implemented as described above are illustrated in FIGS. 1 and 2.

As shown in these figures, the CVVT bolt release detection logic includes deciding whether a camshaft position sensor is operating normally (S100), learning the most retarded angle position of a camshaft using the camshaft position sensor (S200), deciding whether the learning of the most retarded angle position of the camshaft is normal (S300), and when the learning of the most retarded angle position of the camshaft is normal, comparing a PWM duty angle used in the learning with a set first reference value (S400).

First, it is decided whether the camshaft position sensor capable of detecting a rotational angle of the camshaft is operating normally. Then, if it is decided that the camshaft position sensor is operating normally, the most retarded angle position of the camshaft is learned using the camshaft position sensor.

It will be apparent that the learning of the most retarded angle position of the camshaft is performed with a PWM duty value transmitted from the ECU.

Meanwhile, it is determined whether the learning of the most retarded angle position of the camshaft is normal. In this case, a normal range of the most retarded angle position is stored in the ECU, and it is decided whether the most retarded angle position of the camshaft is within the range.

Subsequently, when the most retarded angle position of the camshaft is within the normal range previously stored in the ECU, a PWM duty value used in learning of the most retard position of the camshaft is compared with a first reference value previously stored in the ECU.

That is, when the learning of the most retarded angle position of the camshaft is normal, it is decided that the fastening bolt in the CVVT has been released when the PWM duty value used in the learning is smaller than the first reference value, for example, 45%.

Figure 2:
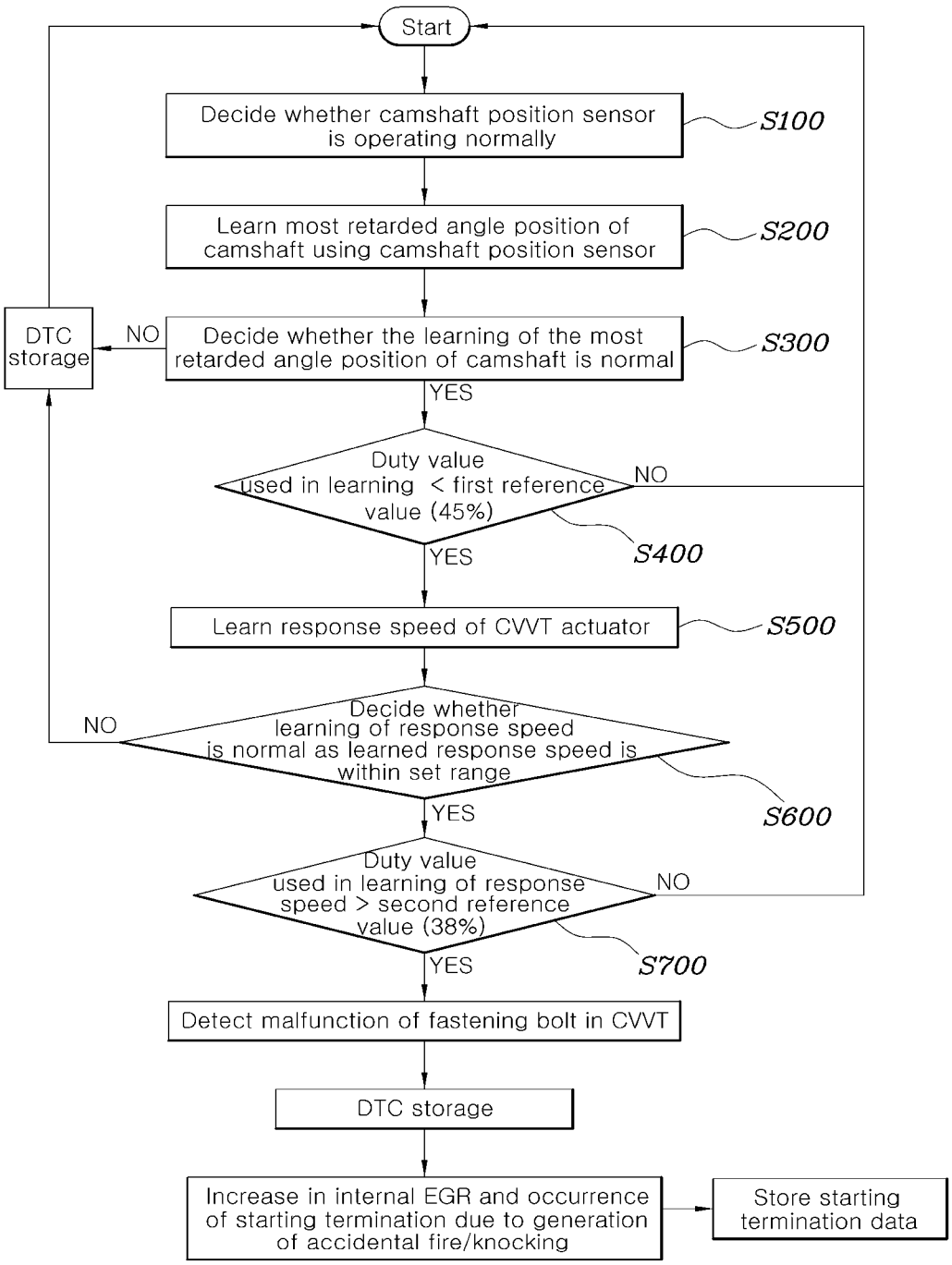

Meanwhile, the present invention, as shown in FIG. 2, further includes comparing a PWM duty value used in learning of the response speed of the CVVT with a set second reference value so that the release phenomenon of the fastening bolt in the CVVT is more accurately and surely decided together with the method of the PWM duty value used in the learning with the first reference value.

That is, the CVVT bolt release detection logic, as shown in FIG. 2, further includes, after the comparing the PWM duty value used in the learning with the set first reference value when the learning of the most retarded angle position of the camshaft is normal, learning a response speed of the CVVT actuator (S500), deciding whether the learning of the response speed is normal as the learning response speed is within a set range (S600), and when the learning of the response speed is normal, comparing the PWM duty value used in the learning with a set second reference value (S700).

First, if it is decided that the PWM duty value in the learning is smaller than the first reference value when the learning of the most retarded angle position of the camshaft is normal, the learning of the response speed of the CVVT actuator is performed.

Figure 3:
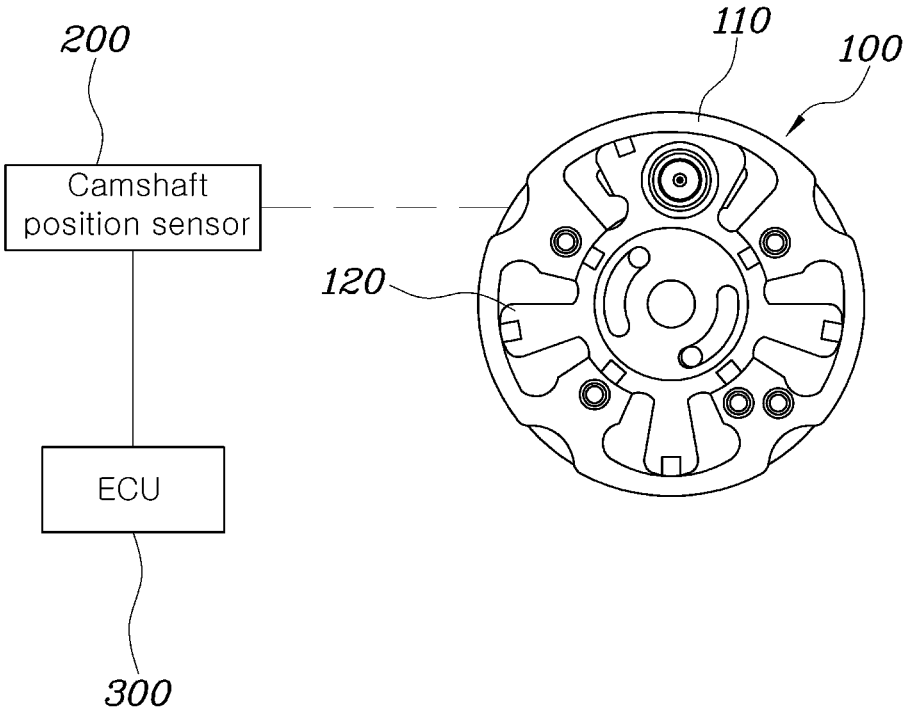
FIG. 3 is a configuration view illustrating a system for detecting malfunction of a fastening bolt in a CVVT in accordance with an embodiment of the present invention.

A CVVT actuator 100, as shown in FIG. 3, includes a housing 110 and a rotor 120. The housing 110 is connected to a camshaft sprocket (not shown), and the rotor 120 mounted in the housing 110 is connected to the camshaft (not shown). The response speed of the CVVT actuator 100 means a response speed when the rotational phase of the rotor 120 with respect to the housing 110 is changed.

In this state, it is decided whether the learning of the response speed is normal as the learned response speed is within a set range. In this case, the set range is also stored in the ECU, so that it is decided whether the response speed is first within a normal range.

When it is decided that the response speed is within the normal range, the PWM value used in the learning of the response speed is compared with the second reference value.

In this state, when the PWM duty value used in the learning of the response speed is greater than the set second reference value, for example, 38%, it is decided that the release phenomenon of the fastening bolt in the CVVT has occurred.

That is, it is characterized that the first reference value is 45% and the second reference value is 38%. When the PWM duty value used in the learning is smaller than the set first reference value when the learning of the most retarded angle position of the camshaft is normal, and the PWM duty value used in the learning is greater than the set second reference value when the learning of the response speed is normal, it is decided that malfunction has occurred in the fastening bolt in the CVVT.

Meanwhile, FIG. 3 is a configuration view illustrating a system for detecting malfunction of a fastening bolt in a CVVT in accordance with an embodiment of the present invention.

As shown in this figure, the system includes a camshaft position sensor 200, the CVVT actuator 100 including the housing 110 and the rotor 120 mounted in the housing 110, and a controller (ECU) 300 that transmits a PWM duty value for rotation of the camshaft and a PWM duty value for operation of the CVVT actuator 100, and stores the transmitted PWM values. The controller 300 decides that malfunction has occurred in the fastening bolt in the CVVT when the PWM duty value in the learning is smaller than the set first reference value when it is decided that the learning of the most retarded angle position of the camshaft is normal.

Also, the controller 300 decides that the malfunction has occurred in the fastening bolt in the CVVT when the PWM duty value used in the learning is greater than the set second reference value when it is decided that the learning of the response speed of the CVVT actuator 100 is normal.

According to the method and system of the present invention configured as described above, it is possible to trace the history of a vehicle with respect to the termination of starting. Further, it is possible to facilitate the establishment of service plan. Further, it is possible to more accurately and easily detect the release phenomenon of the fastening bolt.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A system for detecting malfunction of a fastening bolt in a CVVT, the system comprising:

a CVVT actuator configured to include a housing and a rotor mounted in the housing;

a camshaft position sensor learning the most retarded angle position of a camshaft; and a controller configured to transmit a PWM duty value for rotation of a camshaft and a PWM duty value for operation of the CVVT actuator and store the transmitted PWM duty values, wherein, when it is determined that the learning of the most retarded angle position of the camshaft is normal, and a PWM duty value used in the learning is smaller than a set first reference value, the controller determines that malfunction has occurred in the fastening bolt in the CVVT.

2. The system of claim 1, wherein, when the learning of the response speed of the CVVT actuator is normal, and a PWM duty value used in the learning is greater than a set second reference value, the controller determines that malfunction has occurred in the fastening bolt in the CVVT.

* * * * *